United States Patent [19]

Pircher

[11] Patent Number: 4,589,567

[45] Date of Patent: May 20, 1986

[54] CONTAINER AND COVER HAVING RESILIENT FASTENING MEANS

[75] Inventor: Herbert Pircher, Planegg, Fed. Rep. of Germany

[73] Assignee: Buro Patent AG, Glarus, Switzerland

[21] Appl. No.: 763,142

[22] PCT Filed: Dec. 13, 1984

[86] PCT No.: PCT/CH84/00195

§ 371 Date: Jul. 31, 1985

§ 102(e) Date: Jul. 31, 1985

[87] PCT Pub. No.: WO85/02593

PCT Pub. Date: Jun. 20, 1985

[30] Foreign Application Priority Data

Dec. 15, 1983 [CH] Switzerland ..... 6682/83

[51] Int. Cl.[4] ..... B65D 45/16

[52] U.S. Cl. ..... 220/326; 220/337

[58] Field of Search ..... 220/326, 337, 338, 343

[56] References Cited

U.S. PATENT DOCUMENTS

| | | | |
|---|---|---|---|
| 1,330,012 | 2/1920 | Satzman | 220/326 |
| 3,137,408 | 6/1964 | Taylor | 220/326 |
| 3,610,460 | 10/1971 | Siklos | 220/337 |

*Primary Examiner*—George T. Hall

*Attorney, Agent, or Firm*—Karl F. Ross; Herbert Dubno

[57] ABSTRACT

On the reception part (2) there is arranged a cover (4) which is connected on the opposite side (6) of the container by combined snap closures (8) to the reception part (2). In order to be able to use the combined snap closure optionally as closures, respectively as hinge, each combined snap closure comprises a lock (14) prestressed in closed position by a spring (30) and overlapping by means of a lug (20) in the closed position a recess (24) wherein there is pivotingly arranged a joint pin (26). On the lug (20) there is provided an inclined surface (32) by means of which the lock bolt (14) may be disengaged from the closed position in order to engage the combined snap closure by means of the joint bolt (26). The lock bolt (14) is joined to the reception part (2) of the container and the joint bolt (26) to the cover (4).

5 Claims, 3 Drawing Figures

CONTAINER AND COVER HAVING RESILIENT FASTENING MEANS

CROSS REFERENCE TO RELATED APPLICATION

This application is a national phase application corresponding to PCT/CH 84/00195 filed Dec. 13, 1984 and based upon a Swiss National application 6682/83-9 filed Dec. 15, 1983 under the International Convention.

FIELD OF THE INVENTION

The invention relates to a container, especially for a conveyor system, which comprises a container body closable by a lid, the lid being connected to the container body on one side of the container by a hinge and on the opposite side by means of a snap lock.

BACKGROUND OF THE INVENTION

Containers, particularly for a conveyor system as mentioned above, are known, e.g. from CH-PS 496 603. Because the lid of such a conveyor can be opened only from one side, the access from the other side is very difficult. Moreover, the containers can then be used only in a certain assembly configuration.

OBJECT OF THE INVENTION

It is the object of the invention to provide a container of the aforedescribed type in which access to the interior is afforded from opposite sides of the container.

SUMMARY OF THE INVENTION

This object is achieved with a container which has on each side at least one combination snap closure formed as a hinge, which includes on one section of the container a latch formed as part of the hinge and held in closed position by a spring which cooperates manually detachably with the other hinge portion on the other container section, where the latch and/or the other hinge portion has a ramp surface for the automatic engagement of the combination snap lock. Unobstructed accessibility of the container from opposite sides is assured by the fact that the lock is designed as a combination snap lock which acts both as a hinge and as an opener for the container. Additionally, the automatic engagement of the combination snap lock always assures a secure closing of the container. Moreover, the position of the container in the conveyor system is no longer of importance.

Advantageous features of the container include that the latch is disposed on a lid or that the latch is disposed on the is disposed on the container body. Each latch can be used as a rocker which being on a rocker portion, a nose which in its closed position engages a fixed bearing element for a hinge pin disposed in the other container section.

Each latch is designed as a hinge pin axially slidable in a guide and which, in its closed position, engages the bore of a bearing element. claims 2–5.

BRIEF DESCRIPTION OF THE DRAWING

The invention is described in detail below in accordance with the drawing which shows.

SPECIFIC DESCRIPTION

Figure 1:
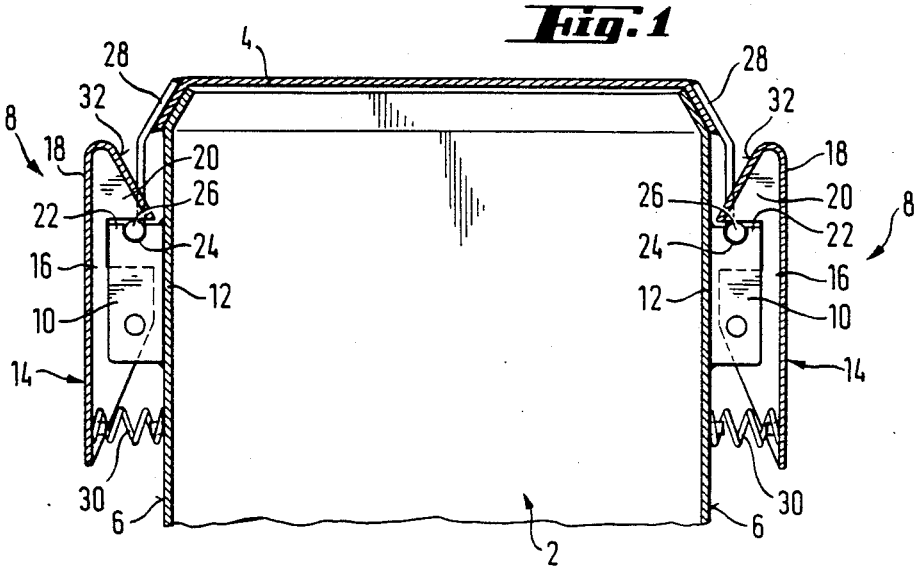
FIG. 1 a container with combination snap locks arranged on opposite sides in vertical section and in part.
Figure 2:
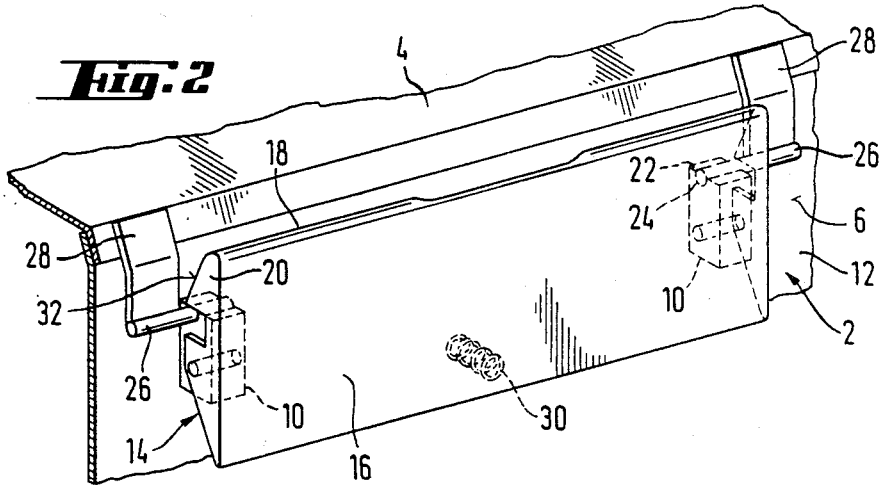
FIG. 2 a combination snap lock on one side of the container in perspective view.

FIG. 1 shows a container which may be used for a conveyor system according to CH-PS 496-603. This container comprises a container body 2 which is closed by a lid 4. Combination snap locks 8 are arranged on the longitudinal sides 6 of the container which may be used for either for opening the container or as hinges.

Each combination snap lock 8 has two block-shaped bearing elements 10 mounted on a side wall 12 of the container body 2. On these bearing elements 10, a latch 14 is rotatably journaled and is realized as a plate-shaped rocker 26. An upper rocker portion 18 contains noses 20 which engage the fixed bearing element 10 in the closed position shown. Each bearing element 10 contains on the side 22, which is engaged by the nose 20 of latch 14, a recess 24 for accepting a hinge pin 26 connected to cover 4 by means of a band element 28. The hinge pin 26 is held in the bearing recess 24 by means of nose 20 which protrudes over side 22 of the bearing element 10. A spring 30 is used for pretensioning the latch 14 into the closed position shown. The latch 14 has on its upper side a ramp surface 32 which enables the automatic actuation of the combination snap lock when the lid is closed. By movement of the hinge pin 26 on the ramp surface 32, the latch 24 is displaced out of its locked position against the force of the spring 30 until the hinge pin 26 snaps in behind the nose 20 of latch 14.

Figure 3:
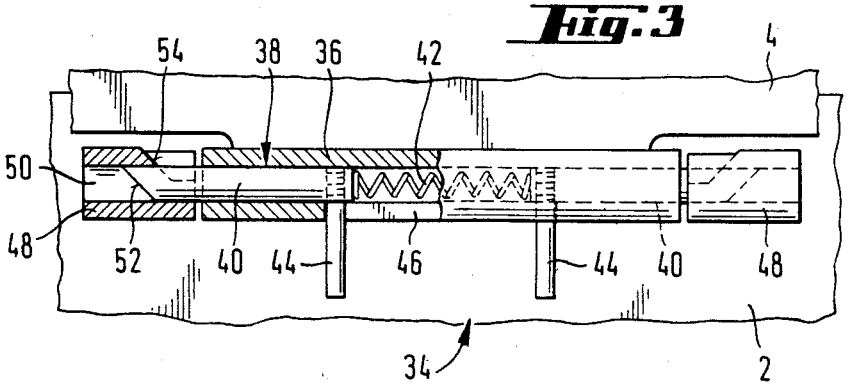
FIG. 3 another combination snap lock in partial vertical section along the linkage axis.

FIG. 3 shows another combination snap lock 34. Here a guide bushing 36 is fastened on lid 4, in which two hinge pins 40 shown as sliding catches 38 are disposed axially slidable against one another. A spring 42 compressed between hinge pins 40 tensions the hinge pins outwardly. Gripper means 40 are fastened on the inner ends opposing one another of the hinge pins, e.g. by screwing and are guided radially outwardly by means of a common longitudinal slot 46 in the guide bushing 36. The gripper means 44 also serve to limit outward axial movement of the hinge pins. These hinge pins 40 cooperate with the bearing elements 48 which are fastened in axial direction on both sides of the guide bushing 36 on the container body 2. The bearing elements 48 contain bores 50 for receiving the hinge pins 40. Ramp surfaces 52, 54 are arranged on hinge pins 40 and bearing elements 48, respectively, thus enabling engagment of the combination snap lock, even without actuation of the gripper means 44. For opening the lock, one need only move the gripper means 44 toward one another while compressing the spring 42.

I claim:

1. In a container, especially for a conveyor system, which comprises a container body closable by a lid, the lid being connected to the container body on one side of the container by a hinge and on the opposite side by means of a snap lock, the lid and body forming respective container sections, the improvement wherein the container has on both of two opposite sides respective container sections and on each side at least one combination snap lock formed as hinge, said snap locks each including on one section of the container a latch formed as part of a hinge and held in closed position by a spring which cooperates manually detachably with another hinge portion on the other container section on the respective side of the container, where the latch and/or the other hinge portion are provided with a ramp surface for the automatic engagement latch and other hinge portion of the respective combination snap lock.

2. A container according to claim 1 wherein that each latch is disposed on a respective lid.

3. A container according to claim 1, characterized in that each latch is disposed on the container body.

4. A container according to claim 1, characterized in that each latch is used as a rocker which has on a rocker portion a nose which in a closed position engages a fixed bearing element for a hinge pin disposed on the other container section.

5. A container as in claim 1, characterized in that each latch is designed as a hinge pin axially slidable in a guide and which, in its closed position, engages a bore of a bearing element.

* * * * *